US009448006B2

(12) United States Patent
Kulkarni et al.

(10) Patent No.: US 9,448,006 B2
(45) Date of Patent: Sep. 20, 2016

(54) TURBO-CHILL CHAMBER USING SECONDARY COOLANT

(71) Applicant: Whirlpool Corporation, Benton Harbor, MI (US)

(72) Inventors: Tushar V. Kulkarni, St. Joseph, MI (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 292 days.

(21) Appl. No.: 13/963,066

(22) Filed: Aug. 9, 2013

(65) Prior Publication Data

US 2013/0319035 A1 Dec. 5, 2013

Related U.S. Application Data

(63) Continuation of application No. 12/849,232, filed on Aug. 3, 2010, now abandoned.

(51) Int. Cl.

| | |
|---|---|
| ***F25D 25/00*** | (2006.01) |
| ***F25D 11/02*** | (2006.01) |
| ***F25D 31/00*** | (2006.01) |

(52) U.S. Cl.

CPC ..... *F25D 25/00* (2013.01); *F25D 11/025* (2013.01); *F25D 31/007* (2013.01); *F25D 2331/803* (2013.01); *F25D 2400/28* (2013.01)

(58) Field of Classification Search

CPC .... F25D 25/00; F25D 31/007; F25D 11/025; F25D 2400/28

See application file for complete search history.

(56) References Cited

U.S. PATENT DOCUMENTS 3,302,427 A * 2/1967 Schneider ..... F25D 3/08 220/903
4,358,932 A 11/1982 Helfrich, Jr.
4,368,622 A 1/1983 Brooks (Continued)

FOREIGN PATENT DOCUMENTS

EP 1684031 A2 7/2006
JP 62280569 A 12/1987

(Continued)

OTHER PUBLICATIONS

Air Pressure, May 7, 2012, National Weather Service Southern Region Headquarters, 3 pages.

(Continued)

*Primary Examiner* — Emmanuel Duke

(57) ABSTRACT

An appliance system that includes an appliance and a turbo-chilling chamber is provided. In one embodiment, the turbo-chilling chamber for chilling a beverage within a beverage container or a foodstuff is operably engaged to an interior surface of the appliance and typically includes a rigid outer wall; a flexible inner wall defining a coolant chamber; and at least one coolant spaced between the rigid outer wall and flexible inner wall in the coolant chamber. The flexible inner wall defines a receiving space, accommodates various sized beverage containers or foodstuffs, and moves between a first position and a second position. The coolant within the coolant chamber is typically at higher than atmospheric pressure when the flexible inner wall is in the second position and a lesser pressure when the flexible inner wall is in the first position. The method of turbo-chilling a beverage container/beverage/foodstuff within the turbo-chilling chamber is also provided.

18 Claims, 6 Drawing Sheets

(56) References Cited

U.S. PATENT DOCUMENTS

| | | | | |
|---|---|---|---|---|
| 4,531,381 | A * | 7/1985 | Toro | B65D 81/3834 62/372 |
| 5,100,213 | A | 3/1992 | Vandarakis et al. | |
| 5,207,762 | A | 5/1993 | Newman | |
| 5,372,017 | A | 12/1994 | Zorea et al. | |
| 5,845,514 | A | 12/1998 | Clarke et al. | |
| 5,983,662 | A | 11/1999 | Luetsch | |
| 6,018,961 | A | 2/2000 | Venture et al. | |
| 6,050,104 | A | 4/2000 | Corona | |
| 6,085,542 | A | 7/2000 | Johnson et al. | |
| 6,158,227 | A | 12/2000 | Seeley | |
| 6,237,360 | B1 | 5/2001 | Corona | |
| RE37,213 | E * | 6/2001 | Staggs | A47G 19/2288 62/457.3 |
| 6,314,751 | B1 | 11/2001 | Gjersvik | |
| 6,405,544 | B2 | 6/2002 | Hiraoka et al. | |
| 6,526,766 | B1 | 3/2003 | Hiraoka et al. | |
| 6,662,574 | B2 | 12/2003 | Loibl et al. | |
| 6,694,770 | B2 | 2/2004 | Winders et al. | |
| 6,802,369 | B2 | 10/2004 | Zentner et al. | |
| 6,880,949 | B2 | 4/2005 | Miozza et al. | |
| 6,983,615 | B2 | 1/2006 | Winders et al. | |
| 7,000,407 | B2 | 2/2006 | Miozza et al. | |
| 7,093,453 | B2 | 8/2006 | Asan et al. | |
| 7,096,936 | B1 | 8/2006 | Chastine et al. | |
| 7,343,748 | B2 * | 3/2008 | Freesmeier | F25D 17/065 62/407 |
| 7,347,055 | B2 | 3/2008 | Lucas | |
| 2005/0126208 | A1 * | 6/2005 | Yang | F25D 3/08 62/457.4 |
| 2005/0166605 | A1 | 8/2005 | Forbes et al. | |
| 2006/0156755 | A1 | 7/2006 | Ouseph et al. | |
| 2006/0260352 | A1 * | 11/2006 | Anderson | F25D 11/02 62/440 |
| 2007/0101734 | A1 * | 5/2007 | Lucas | F25D 31/007 62/62 |
| 2007/0151284 | A1 | 7/2007 | Freesmeier et al. | |
| 2008/0134695 | A1 | 6/2008 | Loibl et al. | |
| 2008/0156033 | A1 * | 7/2008 | Cur | F25B 25/00 62/448 |
| 2008/0209930 | A1 * | 9/2008 | Taras | F25B 13/00 62/228.1 |
| 2008/0307822 | A1 * | 12/2008 | Richardson | A61G 17/002 62/376 |
| 2009/0229298 | A1 | 9/2009 | Allard et al. | |
| 2009/0302724 | A1 | 12/2009 | Allard et al. | |
| 2010/0043455 | A1 | 2/2010 | Kuehl et al. | |
| 2010/0073872 | A1 | 3/2010 | Pakravan | |
| 2010/0223944 | A1 | 9/2010 | Tsujimoto et al. | |

FOREIGN PATENT DOCUMENTS

| | | | |
|---|---|---|---|
| JP | 641378 | U | 1/1989 |
| JP | 05288447 | A | 11/1993 |
| KR | 1020050041036 | A | 5/2005 |
| WO | 2010008611 | A2 | 1/2010 |
| WO | 2011037342 | A2 | 3/2011 |
| WO | 2011043602 | A2 | 4/2011 |

OTHER PUBLICATIONS

European Patent Application No. 11173848.0 filed Jul. 13, 2011, Applicant: Whirlpool Corporation; European Search report re: same, mail date: Jan. 23, 2014.

* cited by examiner

TURBO-CHILL CHAMBER USING SECONDARY COOLANT

CROSS-REFERENCE TO RELATED APPLICATIONS

This application is related to U.S. patent application Ser. No. 12/849,232, entitled "DIRECT CONTACT TURBO-CHILL CHAMBER USING SECONDARY COOLANT," filed on Aug. 3, 2010, the entire disclosure of which is incorporated by reference.

BACKGROUND OF THE INVENTION

Individuals who want to quickly chill a beverage in a beverage container are known to place the beverage container directly and loosely within the freezer compartment of an appliance. However, people frequently forget to remove the beverage container from the freezer compartment, which can result in the beverage within the container freezing solid and/or rupture of the beverage container resulting in a significant mess in the interior of the freezer compartment. The discharged liquid then freezes on the material within the freezer and/or on the wall(s) of the freezer and needs to be cleaned, which is often very time consuming and frustrating for a user.

SUMMARY OF THE PRESENT INVENTION

An embodiment of the present invention is generally directed toward an appliance system that includes an appliance and a turbo-chilling chamber. The appliance typically has a rear wall, a first side wall, a second side wall, a top, a bottom and at least one door that, when the door is closed, either partially or completely encloses the interior of the appliance. When all doors of the appliance are closed the appliance contains at least one insulated section that is the same size or smaller than the interior volume of the appliance and suitable for refrigeration of fresh foods, and the rear wall, first side wall, second side wall, top, bottom, and the door each have an interior surface.

The turbo-chilling chamber for chilling a foodstuff(s), typically a beverage within a beverage container, is operably engaged to an interior surface of the appliance and typically includes a rigid outer wall; a flexible inner wall defining a coolant chamber; and at least one coolant spaced between the rigid outer wall and flexible inner wall in the coolant chamber during operation of the turbo-chilling chamber. The flexible inner wall defines a foodstuff (beverage container) receiving space, accommodates various sized foodstuffs (beverage containers), and moves between a first position and a second position. The coolant within the coolant chamber is typically at a higher than atmospheric pressure when the flexible inner wall is in the second position and at a lesser pressure when the flexible inner wall is in the first position.

Yet another embodiment of the present invention includes a turbo-chilling chamber for chilling a foodstuff, typically a beverage within a beverage container, that is capable of being operably engaged to an interior surface of an appliance (freezer or refrigerator compartment). The turbo-chilling chamber typically has a rigid outer boundary perimeter that has a rear wall and side walls and is larger than a foodstuff (beverage container) and surrounds the side and bottom of a foodstuff (beverage container) when the foodstuff (beverage container) is spaced within the turbo-chilling chamber. The turbo-chilling chamber also includes a flexible inner wall spaced within the rigid outer boundary perimeter that typically surrounds the side and bottom of the foodstuff (beverage container) when the foodstuff (beverage container) is spaced within the turbo-chilling chamber. The rigid outer boundary perimeter and the flexible inner wall define a coolant chamber therebetween that has at least one coolant spaced in the coolant chamber. The flexible inner wall defines a foodstuff (beverage container) receiving space; is sized to receive various sized foodstuffs (beverage containers); and moves between a first position and a second position. The coolant within the coolant chamber is typically at a higher than atmospheric pressure when the flexible inner wall is in the second position and at a lesser pressure when the flexible inner wall is in the first position.

Yet another embodiment of the present invention is generally directed toward a method of turbo-chilling a foodstuff and a method of turbo-chilling a beverage in a beverage container without the beverage within the beverage container freezing that includes the following steps: providing an appliance having a rear wall, a first side wall, a second side wall, a top, a bottom and at least one door having an interior surface such that when the door is closed it either partially or completely encloses the interior of the appliance and wherein when all doors of the appliance are closed the appliance contains at least one insulated section that is the same size or smaller than the interior volume of the appliance; providing a turbo-chilling chamber for chilling a foodstuff and/or a beverage within a beverage container operably engaged to an interior surface of the appliance where the turbo-chilling chamber includes a rigid outer wall; a flexible inner wall defining a coolant chamber; and at least one coolant spaced between the rigid outer wall and flexible inner wall in the coolant chamber. The flexible inner wall defines a foodstuff (beverage container) receiving space that accommodates various sized foodstuffs (beverage containers) and the chamber also typically further includes at least one coolant between the rigid outer wall and flexible inner wall in the coolant chamber.

The method typically also includes the steps of providing a coolant system positioned within the appliance where the coolant system includes a coolant tank; a coolant pump; at least two coolant utility conveying lines that operably connect the coolant tank with the coolant outlet and the coolant inlet of the turbo-chilling chamber; and an evaporator; operably connecting a first coolant utility conveying line to the coolant inlet; operably connecting a second coolant utility conveying line to the coolant outlet; placing a foodstuff (beverage container) within the foodstuff (beverage container) receiving space; activating the coolant pump to increase the coolant pressure in the coolant chamber above atmospheric pressure; engaging the flexible inner wall with the foodstuff (beverage container) such that at least substantially all of the side surfaces and the bottom surface of the foodstuff (beverage container) contact the flexible inner wall; and moving coolant through the coolant chamber using the coolant pump to thereby chill the foodstuff (beverage within the beverage container) via heat transfer by contact of the flexible inner wall and indirectly the coolant with the foodstuff (beverage container).

DETAILED DESCRIPTION OF THE PREFERRED EMBODIMENTS

Figure 1:
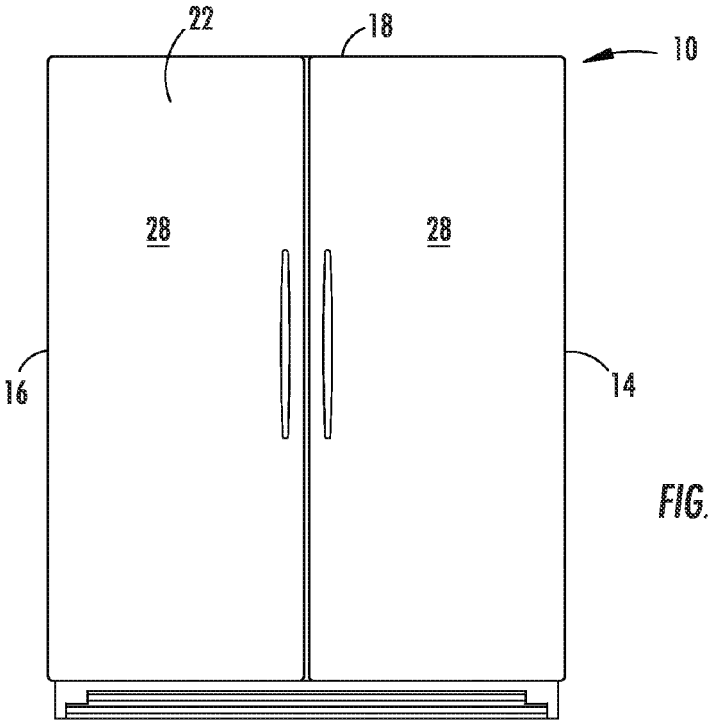
FIGS. 1 and 1A are elevated front plan views of an appliance employing a turbo-chilling chamber.

For purposes of description herein, the terms "upper," "lower," "right," "left," "rear," "front," "vertical," "horizontal," and derivatives thereof shall relate to the appliance as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-1B) generally designates an appliance, typically a refrigerator and freezer combination appliance, which can, for example, be a side by side or have a refrigerator section on top and a freezer section on the bottom portion of the appliance. While not typical, optionally, the appliance can have a refrigerator section only or a freezer section only. Typically, the appliance 10 has both a refrigerated section and a freezer section and the appliance typically has a rear wall section 12, a first side wall section 14, a second side wall section 16, a top 18, a bottom 20, and at least one door 22 providing access to the refrigerator section 24 (See FIGS. 1, 1A, and 1B) where the rear wall section, the first side wall section, the second side wall section, the top and bottom and the door define an appliance interior. The refrigerator section 24 within the appliance interior may have the same or a smaller volume than the overall interior of the appliance, i.e., the appliance may be solely a refrigerator or be an appliance having both a refrigerator section and another section, such as a freezer section with an interior, vertically (or horizontally) extending wall section 15 present to divide the appliance into a freezer section and the refrigerator section 24. The door(s) of the appliance have an exterior surface 28 and an interior surface 30 typically having a door liner 32. The liner is typically formed with a cavity or pocket 34. At least the perimeter defining walls of the appliance and any wall or walls between compartments of different temperatures (freezer vs. refrigerator compartments, for example) are typically insulated with a suitable insulative material such as a urethane foam material or other insulation material, typically a foam insulation material.

Figure 1A:
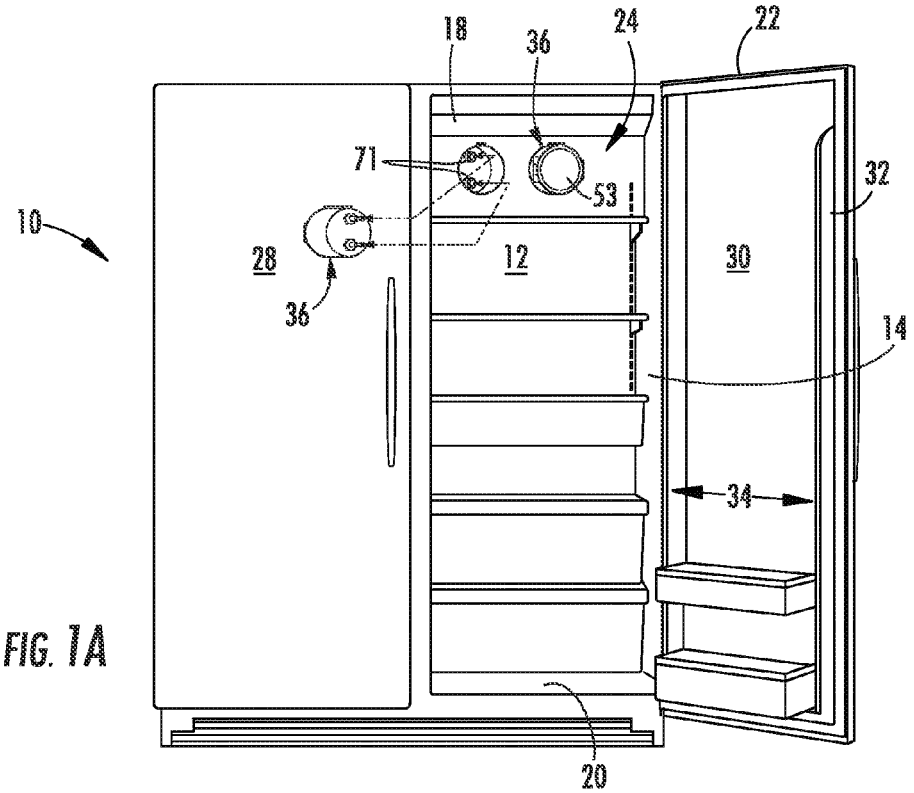
Figure 1B:
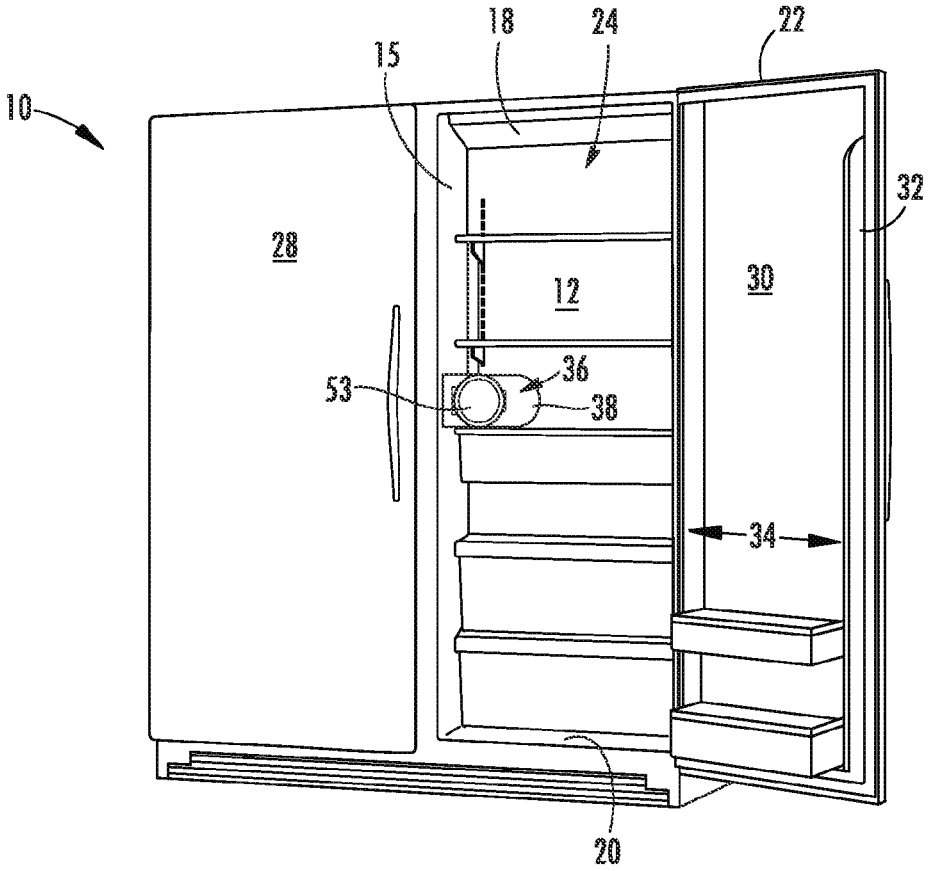
FIG. 1B is a center-right perspective view of an embodiment of the present invention showing a turbo-chill chamber engaged to the freezer facing wall in the refrigerator section of the appliance so as to enable the turbo-chill chamber to draw freezer air into the chamber as needed to provide the turbo-chilling of a beverage where the beverage container is inserted in an initial, proactivation stage.

As shown generally in FIGS. 1A-1B, one or more turbo-chilling chambers 36 can be spaced within the fresh food section or the freezer section, if present, of the appliance as desired by the end user of the appliance. If the turbo-chilling chamber is spaced within the freezer section, this will accelerate freezing of a beverage or foodstuff placed within the turbo-chilling chamber. As will be discussed in more detail, the turbo-chilling chamber(s) 36 are optionally removable such that the functionality provided can be used when desired by the end user of the appliance and the turbo-chilling chamber(s) stored remote from the appliance when not in use. In this manner, the turbo-chilling chamber does not utilize space for fresh food storage within the fresh foods compartment of the appliance when its functionality is not needed. Optionally, the turbo-chilling chamber may not be removable as well, but rather integrated with the appliance.

When the turbo-chilling chamber(s) are removable, they are typically structurally held in place by a mounting bracket that helps support the turbo-chilling chamber and ensures proper engagement of the turbo-chilling chamber with the appliance to allow the turbo-chilling chamber to receive coolant, mechanical power, and/or electrical power as needed. The turbo-chilling chamber(s) optionally can engage a top or side of the appliance mounted bracket and slide into engagement with both the bracket and the appliance. Alternatively, grooves can be constructed in the liner (interior surface) of the appliance that receive, engage, and support the turbo-chilling chamber(s). These too can be positioned on the various surfaces of the interior of the appliance including the top, bottom, and/or sides, but most typically on the top and/or one or more sides of the appliance.

As shown in FIG. 1B, the turbo-chilling chamber can be mounted and constructed to operably engage the freezer facing surface of the refrigerator section of the appliance. In this manner, instead of or in addition to using a coolant system for the turbo-chilling chamber(s), freezer air may be drawn from the freezer compartment and utilized in cooling the beverage and beverage container or other foodstuff when in the turbo-chilling chamber(s) (see generally FIG. 5 also).

Figure 2A:
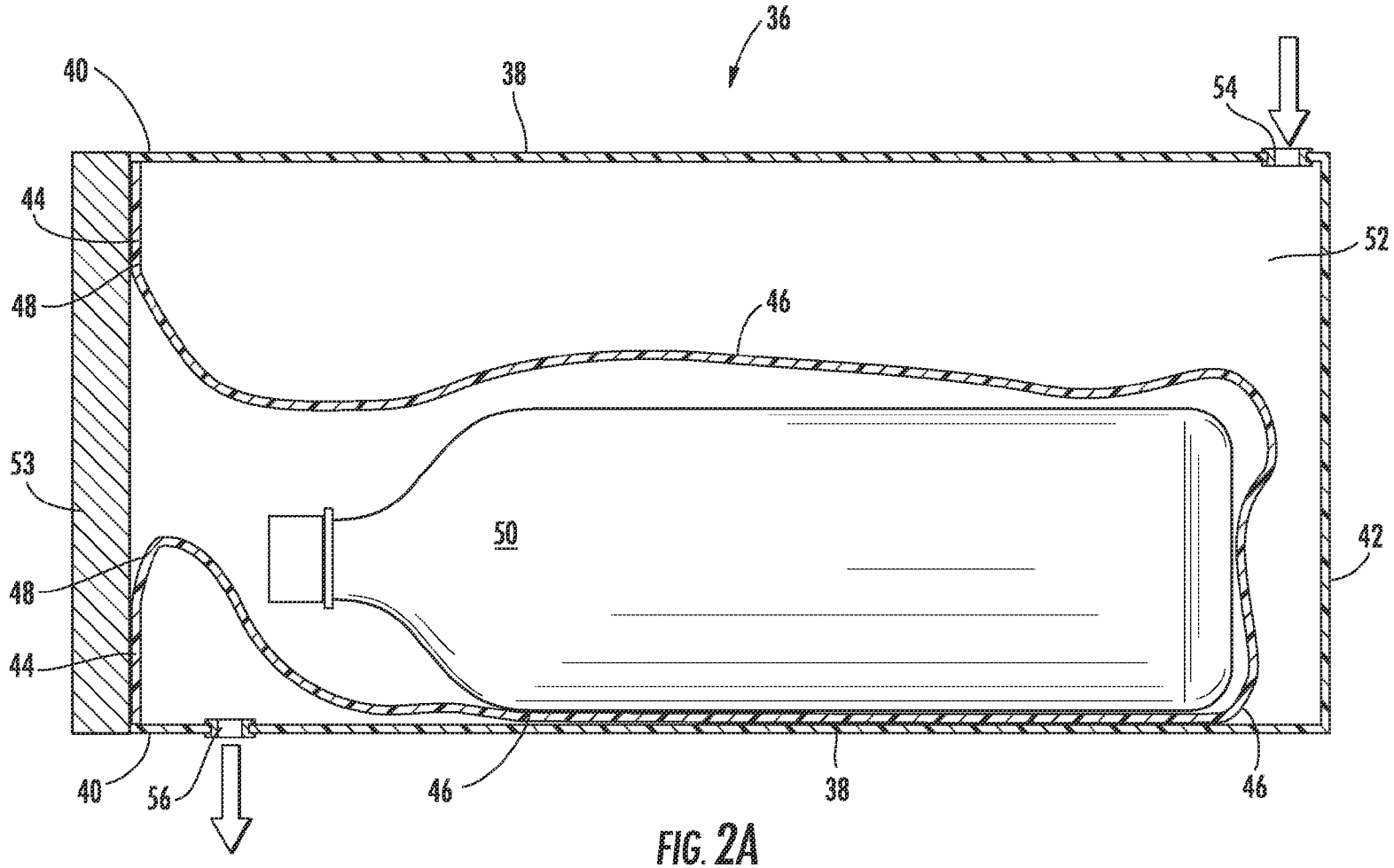
FIG. 2A is a cross-sectional view of a turbo-chilling chamber according to an embodiment of the present invention.
Figure 2B:
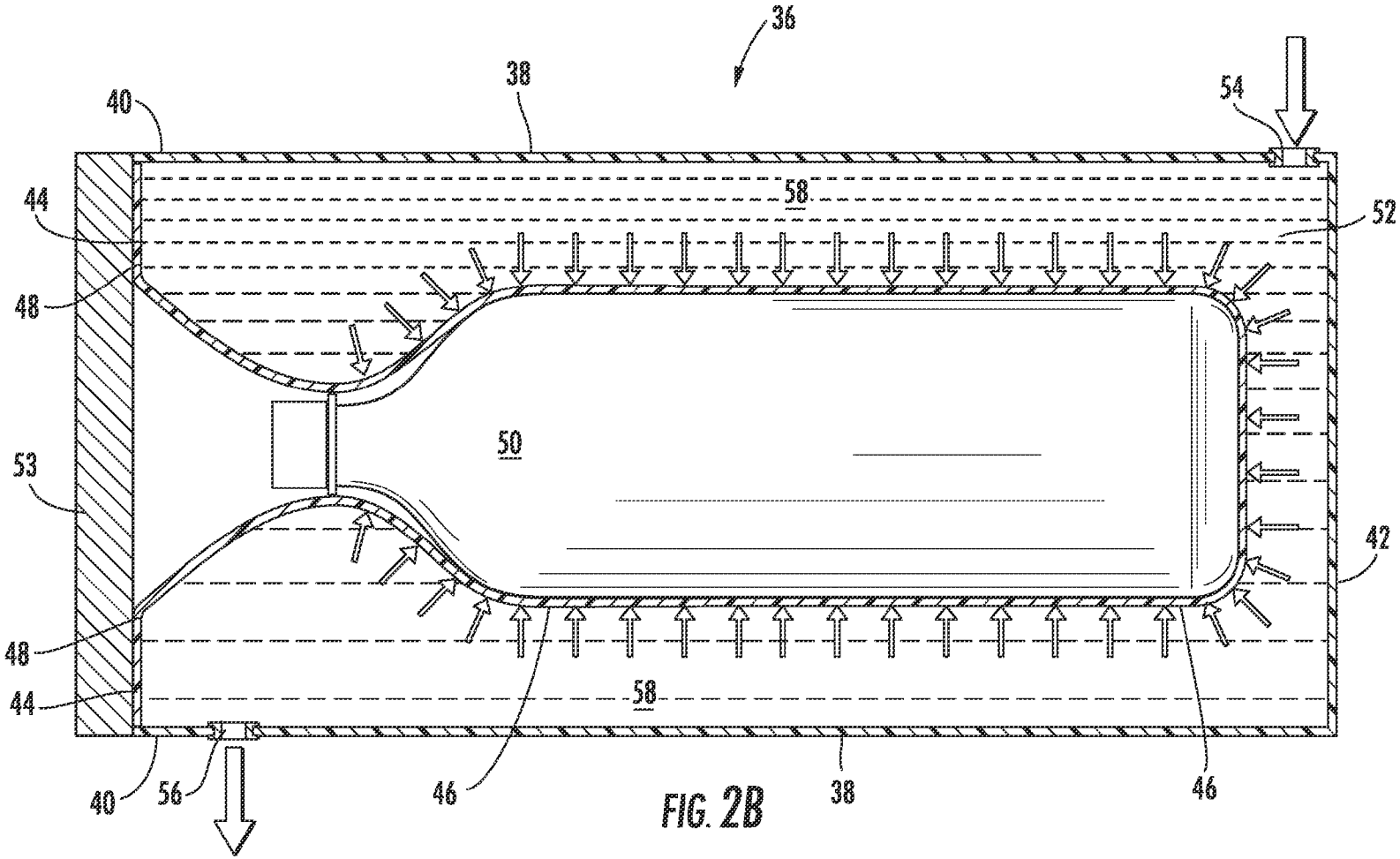
FIG. 2B is a cross-sectional view of the turbo-chilling chamber shown in FIG. 2A, but in the activated, beverage chilling stage.

According to one embodiment of the present invention shown in FIGS. 2A-2B, the turbo-chilling chamber 36 has an outer wall 38 that is typically rigid and typically a hollowed cuboid-shape or a hollowed cylinder-shaped structure and having a beverage container-receiving end 40 and an opposite end that is a rigid base 42 of the outer wall 38. The outer wall may be insulated or not. A perimeter lip 44 that may be of various sizes, but is typically about ¼ to about ½ inches long extends inward from the perimeter of the beverage container (or other foodstuff) receiving end 40 of the outer wall 38. A flexible interior wall or boundary 46 is engaged about the perimeter lip 44, typically at the perimeter lip's inward edge 48. The flexible interior wall surrounds the beverage container 50 (or other foodstuff). The volume between the flexible interior wall and the rigid outer wall define a coolant chamber 52. The turbo-chilling chamber 36 also typically employs a hingedly engaged door 53 that moves between an open beverage inserting/removing position and a closed position that may be secured closed via a magnet system or snap fit connection or other means. The rigid outer wall 38 typically has a coolant inlet 54 and a coolant outlet 56 that are spaced to optimally allow for flow of coolant 58 through coolant chamber 52. Suitable coolants include, but are not limited to, water alcohol solutions such as a propylene glycol and water solution, a salt (brine) and water solution, or a solution of a solute or solutes that depresses the freezing point of the solvent, typically water may be used.

The coolant system 69 (FIG. 3) further includes a coolant tank 60, a coolant pump 62, at least two coolant utility conveying lines 64. The at least two coolant utility lines 64 operably connect the coolant tank 60 with the coolant outlet 56 and the coolant inlet 54 (FIG. 2B) and enable flow of the coolant 58 through the coolant system when the coolant pump 62 is engaged and when the coolant utility conveying lines 64 are connected with the turbo-chilling chamber 36. The coolant system further includes an evaporator 66 and a fan 68.

Figure 3:
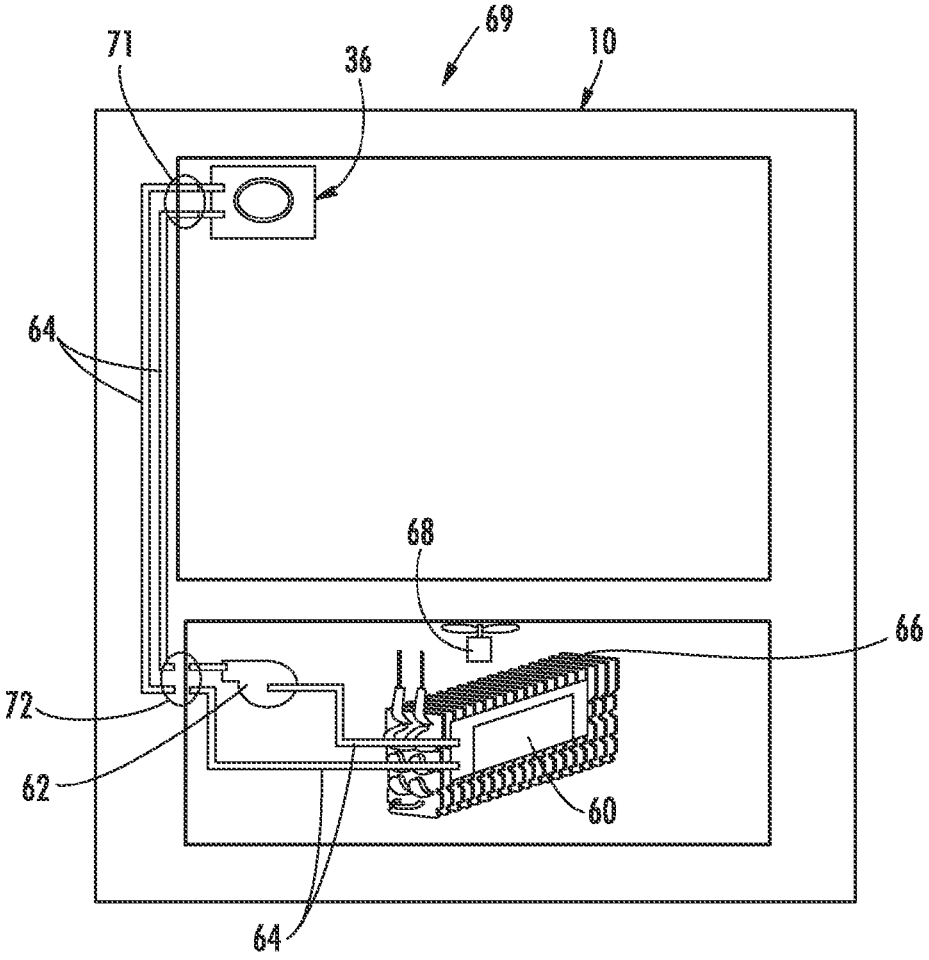
FIG. 3 is a schematic diagram of an overall system according to an embodiment of the present invention showing the coolant tanks and evaporator located remote from the turbo-chilling chamber with the coolant tank in the freezer compartment and the turbo-chilling chamber in another compartment of the appliance, typically the refrigerator compartment.

In operation the turbo-chilling system is engaged to the coolant system contained within the appliance by connecting the coolant utility conveying lines 64 via drip-proof, quick connectors 71, 72, as shown in FIGS. 1A and 3. In this manner, the turbo-chilling chamber 36 can be engaged and disengaged with the appliance as the user needs the functionality or as otherwise user determined. Typically, the coolant utility conveying lines 64 are spaced within the structure of the appliance and insulation is placed (foamed) around the lines 64. Drip-proof quick connectors 71, 72 are optionally used at both ends of the coolant utility lines as desired to connect the turbo-chilling chamber and the cooling system, which is typically positioned remote from the turbo-chilling chamber, but still within the appliance. Typically, at least the evaporator 66, the fan 68, and the coolant pump 62 components of the cooling system are positioned within the freezer with the coolant tank/reservoir in contact with or a part of the evaporator cover. The coolant tank/reservoir at least partially if not entirely contacting the evaporator cover enables the coolant within the tank to be maintained at a temperature below the temperature of the freezer, which is particularly advantageous for turbo-chilling.

The beverage container 50 can be any size and commercially available beverage container or a personal use article such as a refillable filtered or unfiltered water bottle. Non-limiting examples include: 12 ounce cans, 20 ounce plastic bottles, glass soda pop and beer bottles, wine bottles (typically ¾ liter), one liter bottles, and two liter bottles, typically soda pop bottles. The beverage containers are typically sealed and optionally resealable after opening. Other foodstuffs may also be chilled within the chamber. In the case of each embodiment of the turbo-chilling chambers discussed herein the beverage containers may be optionally rotated or shaken slowly with for example, an ultrasonic shaker, to further enhance the cooling of the beverage within the beverage container. A motor can optionally rotate or shake the container. Moreover, the coolant pump can provide the oscillatory motion by pulsing the pump flow and having the coolant inlet port 54 introduce coolant into the chamber approximately tangentially to the beverage container to provide a fluid shear force on the flexible interior wall or boundary 46. Additionally, the coolant flow can be linked to a drive member via a bulb or paddle so that oscillatory motion can be imparted using the coolant flow via the drive member to the beverage container—flexible wall combination thereby moving the beverage container, for example by rotating or shaking the container. When a motor is used to rotate the beverage container, the motor is typically run such that the beverage container makes about one-eighth to about one-quarter revolutions at an approximate rotational speed range of 10 to 30 revolutions per minute. Slow rotation or shaking the beverage container is one method that the present invention employs to facilitate the prevention of localized freezing of the contents of the beverage container while still allowing for turbo-chilling of the contents of the beverage container by promoting mixing of fluid layers within the beverage container.

In operation, as shown in FIGS. 2A-2B, the beverage container is inserted in the turbo-chilling chamber(s) (see FIG. 2A) once the door of the chamber 53 is closed, the turbo-chilling chamber(s) may be activated automatically or based upon user input using a display or the input/output device. Upon activation, the coolant pump 62 pumps coolant 58 through the system. A higher than atmospheric pressure is achieved within the coolant chamber 52, which forces the flexible inner wall 46 into substantial engagement or complete engagement with at least the sides and bottom surface of the beverage container. Heat is thereby transferred from the beverage container through the flexible wall and to the coolant, which is then cycled in a continuous or batch mode through the coolant system 69.

Other embodiments of the present invention are shown in FIGS. 4A-4C and FIG. 5. According to these embodiments of the turbo-chilling chamber of the present invention, the turbo-chilling chamber 136 has an outer wall 138 that is typically rigid and typically a hollowed cuboid-shape or hollowed cylinder-shaped structure. The turbo-chilling chamber 136 also has a beverage container receiving end 140 and an opposite end that is a rigid base 142 of the outer wall 138. The outer wall 138 may be insulated, partially insulated, or not insulated. The turbo-chilling chamber(s) of this embodiment also includes a door 153, which, like door 53, can be insulated and optionally contain structure (clasp, magnet etc.) to hold the door in a closed position when the door is closed by a user.

Figure 4B:
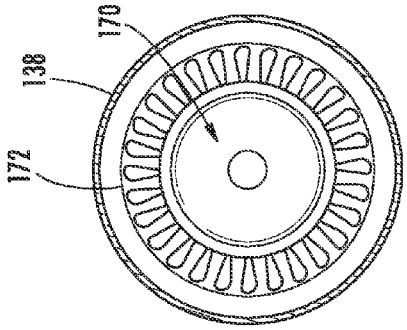
FIG. 4B is a cross-sectional view of the turbo-chilling chamber shown in FIG. 4A taken at line 4B-4B in FIG. 4A.
Figure 4A:
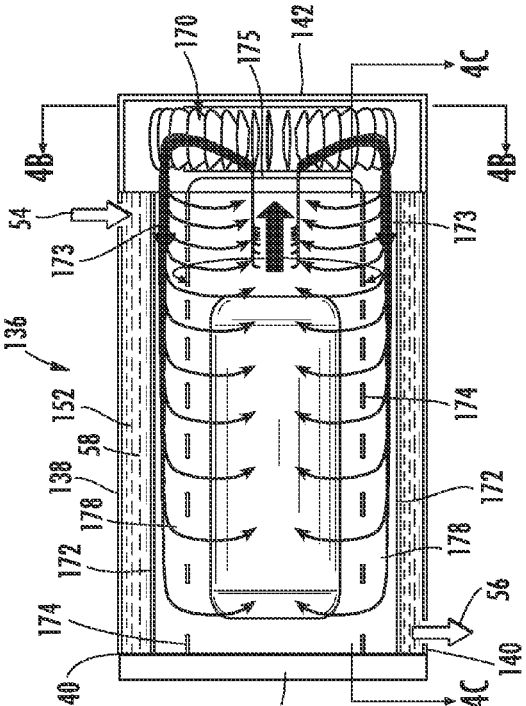
FIG. 4A is a top schematic view of a turbo-chilling chamber according to another embodiment of the present invention.
Figure 4C:
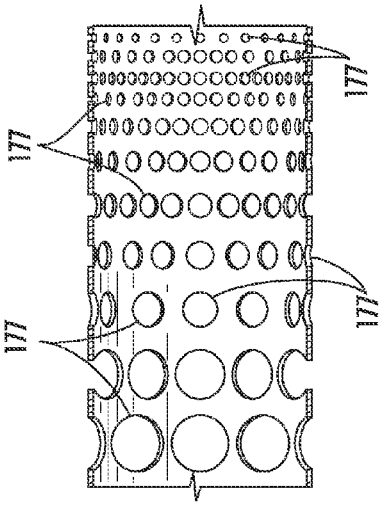
FIG. 4C is a cross-section view taken at line 4C-4C in FIG. 4A.

The embodiment of FIGS. 4A-4C of the present invention the turbo-chilling chamber also includes a middle wall 172, optionally a fan 170, and an inner wall 174, but the inner wall 174 in this embodiment is a rigid and typically perforated rigid structure having a plurality of apertures 177 that allow air flow therethrough. The coolant chamber 152 for holding coolant 58, which is as discussed previously, typically a liquid solution, is defined by the middle wall 172 and the outer wall 138 (see FIG. 4A). The rigid inner wall 174 typically has a plurality of apertures that may be differently sized to regulate and form a consistent or heat transfer optimized airflow from front to back of the turbo-chilling chamber (see FIG. 4C). In a preferred embodiment the apertures are spaced such that the airflow swirls around the container at an angle in a tornado-like motion or pattern. For example, the apertures may have a larger diameter the further they are located from the fan 170 to facilitate optimizing the airflow rate of the air traveling past the entirety of the beverage container within the turbo-chilling chamber since the larger apertures will allow more airflow therethrough and will typically result in the air moving past the beverage container being cooler since the air being pulled out by the fan will travel past more of the coolant that resides within the coolant containing space 176 between the outer wall 138 and the middle wall 172.

In yet another version of this embodiment the apertures are all substantially located at the half way point from the end 175 of the inner wall 174. The end 175 typically has at least one, more typically a plurality of apertures to allow airflow therethrough where appropriate and allow the air to continue to be circulated and/or recirculated. The configuration of the apertures both in the end 175 and along the inner wall 174 may be set and/or configured for a particular use as well. The airflow 173 will travel in the airflow-chilling channel 178 between the middle wall 172 and the inner wall 174 to be chilled and then moved past the beverage container thereby chilling the beverage container and the beverage inside.

As with the previous turbo-chilling chamber of the present invention, the outer wall of this embodiment similarly has a coolant inlet 54 and a coolant outlet 56 for coolant to travel through the coolant chamber 152 adjacent the airflow-chilling channel 178 in the turbo-chilling chamber 136. Each of the inlet and outlet typically are connected to the coolant utility conveying lines 64 via quick connectors and the coolant run through a coolant system as discussed above.

Figure 5:
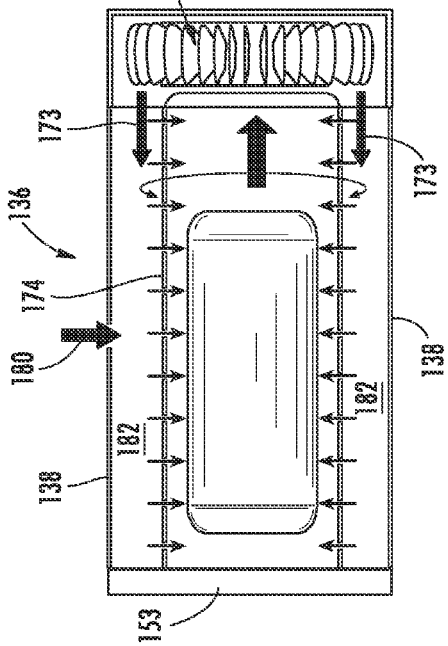
FIG. 5 is an elevated cross-sectional view of a turbo-chilling chamber according to yet another embodiment of the present invention.

In a slight variation of the embodiment shown in FIGS. 4A-4C, as shown in FIG. 5. In this version, substantially all of the structure described above is the same; however, there is at least one or a plurality of apertures in the outer wall 138 and the middle wall 172 is typically removed. Also, the fan 170 is optional, but typically used. Chilling air 180 is provided, which is typically drawn from the chilled air of the freezer. The chilled air then moves through the chilled air space 182 and through aperture 177 in the inner wall 174 to chill the beverage when it is located in the turbo-chilling chamber 136. The fan 170, when present and activated, facilitates faster chilling of the beverage by increasing the air flow from the chilled air source, such as a freezer compartment. Alternatively, a fan can be located between the turbo-chilling chamber and the freezer compartment or proximate within the freezer compartment to force air directly into the turbo-chilling chamber as opposed to pulling air through the turbo-chilling chamber. A combination of fans at these locations may also be used.

In the case of each of the embodiments of the present invention, the turbo-chilling chamber may have one or more temperature sensors that sense the temperature of the interior of the chamber and/or the surface(s) of the beverage container and provide a signal or otherwise communicate with a processor of a computer system that has a memory subsystem storing code. The computer system has a user interface that is operably connected with the processor. The user interface receives input from the user and transmits a signal of that input to the processor. For example, the user of the appliance and turbo-chilling chamber can select a time period for cooling the beverage (foodstuff), cool the beverage (foodstuff) at a certain temperature and optionally keep the beverage (foodstuff) at a certain temperature, cool the beverage (foodstuff) to a predetermined temperature such as one temperature for white wine, one for red wine (or the particular type of wine) or one for a soda pop beverage. The user interface may be a touch screen panel proximate or remote to the turbo-chilling chamber. Conceivably, an alarm/reminder sound emitter may also be operably connected to and in communication with the computer system and/or processor such that, for example, a signal (audio and/or visual) is transmitted after a predetermined time has elapsed since the turbo-chilling chamber has been activated or a signal (audio and/or visual) is transmitted when the beverage or other foodstuff has reached a certain temperature or approximately a certain temperature.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. An appliance system comprising: an appliance having a rear wall, a first side wall, a second side wall, a top, a bottom and at least one door that, when the door is closed, either partially or completely encloses the interior of the appliance, wherein when all doors of the appliance are closed the appliance contains at least one insulated section that is the same size or smaller than the interior volume of the appliance and suitable for refrigeration of fresh foods, and wherein the rear wall, first side wall, second side wall, top, bottom, and the door each have an interior surface; and a turbo-chilling chamber operably engaged to an interior surface of the appliance, and having a main body portion wherein the turbo-chilling chamber comprises: a rigid outer wall; a flexible inner wall defining a coolant chamber; and at least one coolant disposed between the rigid outer wall and flexible inner wall in the coolant chamber during operation of the turbo-chilling chamber; and wherein the flexible inner wall defines a foodstuff receiving space and wherein the flexible inner wall accommodates various sized foodstuffs and moves between a first position and a second position and wherein the flexible inner wall is configured to maintain direct contact with substantially all of the surface of a foodstuff when the coolant within the coolant chamber is at a higher than atmospheric pressure when the flexible inner wall is in the second position and is configured to not maintain direct contact with substantially all of the surface of the foodstuff when the coolant is at a lesser pressure when the flexible inner wall is in the first position; and wherein the foodstuff is a beverage within a beverage container and the foodstuff receiving space is a beverage container receiving space where the flexible inner wall accommodates various sized beverage containers and wherein the turbo-chilling chamber further comprises at least one coolant inlet and one coolant outlet and the coolant flows through the coolant chamber and through a coolant system positioned within the appliance and wherein the coolant system comprises: a coolant tank; a coolant pump; an evaporator; and at least two coolant utility conveying lines that operably connect the coolant tank with the coolant outlet and the coolant inlet and enable flow of the coolant through the coolant system when the coolant pump is engaged and when the coolant utility conveying lines are connected with the turbo-chilling chamber.

2. The appliance system of claim 1, wherein the foodstuff is a beverage within a beverage container, the beverage container comprising at least a top and a perimeter, and the foodstuff receiving space is a beverage container receiving space where the flexible inner wall accommodates various sized beverage containers and wherein the rigid outer wall of the turbo-chilling chamber extends around the perimeter of the beverage container, but not the top of the beverage container and the turbo-chilling chamber further comprises a cover moveable between a beverage actuating position and a closed position and wherein the turbo-chilling chamber further comprises a motor that shakes or rotationally oscillates the beverage container when the beverage container is spaced within the chamber and the flexible wall is in the second position.

3. The appliance system of claim 2, wherein the appliance comprises a plurality of turbo-chilling chambers operably engaged to one or more of the interior surfaces of the appliance and the cover is hingedly connected to the main body portion of the turbo-chilling chamber.

4. The appliance system of claim 1, wherein the coolant comprises a water and solute solution where the solute depresses the freezing point temperature of the water.

5. The appliance system of claim 4, wherein, when in the second position, the flexible inner wall contacts substantially all of the sides and bottom of the beverage container and the water and solute solution includes a water and salt solution or a water and alcohol solution.

6. The appliance system of claim 1, wherein the foodstuff is a beverage within a beverage container and the foodstuff receiving space is a beverage container receiving space where the flexible inner wall accommodates various sized beverage containers and wherein, when in the second position, the flexible inner wall contacts substantially all of the sides and bottom of the beverage container.

7. The appliance system of claim 1, wherein the coolant tank is either part of an evaporator cover or in contact with the evaporator cover.

8. The appliance system of claim 7, wherein the coolant tank is positioned within a freezer compartment within the appliance and the coolant in the tank can be maintained at a temperature lower than that of the freezer compartment.

9. The appliance system of claim 1, wherein the coolant tank is positioned within a freezer compartment within the appliance such that the coolant in the tank can be maintained at a temperature lower than that of the freezer compartment.

10. The appliance system of claim 1, wherein the foodstuff is a beverage within a beverage container and the foodstuff receiving space is a beverage container receiving space where the flexible inner wall accommodates various sized beverage containers and wherein appliance includes both a refrigerated section and a freezer section, and wherein the turbo-chilling chamber is located within the refrigerated or within the freezer section, and wherein a pump drives the coolant and provides oscillatory motion to the beverage to be chilled in the turbo-chilling chamber.

11. The appliance system of claim 1, wherein the foodstuff is a beverage within a beverage container and the appliance system further comprises a pump that drives the coolant and provides oscillatory motion to the beverage to be chilled in the turbo-chilling chamber.

12. The appliance system of claim 1, wherein the appliance system includes a freezer section and the turbo-chilling chamber is located within the freezer section and is capable of freezing the foodstuff within the turbo-chilling chamber at a slower or faster rate than placing the foodstuff in the freezer section outside of the turbo-chilling chamber.

13. The appliance system of claim 1, wherein the insulated section or sections of the appliance comprise foam insulation and the coolant utility conveying lines that connect the coolant tank with the coolant outlet and the coolant inlet and enable flow of the coolant through the coolant system when the coolant pump is engaged are spaced within and held in place by at least a portion of the foam insulation and the coolant utility conveying lines each have a chamber engaging end and a coolant tank engaging end that each have a drip-proof quick connector engaged thereto that operably and releasably engages the coolant tank and the outlet or the inlet of the turbo-chill chamber to one another.

14. The appliance system of claim 1, wherein the foodstuff is a beverage within a beverage container and the foodstuff receiving space is a beverage container receiving space where the flexible inner wall accommodates various sized beverage containers and wherein the turbo-chilling chamber is integral with the appliance and wherein the appliance comprises a freezer section and the turbo-chilling chamber is positioned within the freezer section.

15. The appliance system of claim 1, wherein the foodstuff is a beverage within a beverage container and the foodstuff receiving space is a beverage container receiving space where the flexible inner wall accommodates various sized beverage containers and wherein the turbo-chilling chamber is removably engaged to the appliance and wherein the appliance comprises a refrigerator section that is the insulated section suitable for refrigeration of fresh foods and a freezer section and wherein the turbo-chilling chamber is spaced within either the refrigerator section or the freezer section of the appliance when the turbo-chilling chamber is engaged to the appliance and wherein the turbo-chilling chamber further comprises a coolant inlet directing the coolant in a direction tangential to the beverage container thereby putting a fluid shear force on the flexible wall.

16. A turbo-chilling chamber for chilling a beverage within a beverage container and capable of being operably engaged to an interior surface of an appliance and comprising: a rigid outer boundary perimeter having a rear wall and side walls that is larger than a beverage container and surrounding the side and bottom of a beverage container when the beverage container is spaced within the turbo-chilling chamber, a flexible inner wall spaced within the rigid outer boundary perimeter and surrounding the side and bottom of a beverage container when the beverage container is spaced within the turbo-chilling chamber wherein the rigid outer boundary perimeter and the flexible inner wall define a coolant chamber therebetween having at least one coolant spaced in the coolant chamber, wherein the flexible inner wall defines a beverage container receiving space; is sized to receive various sized beverage containers; and moves between a first position and a second position and wherein the flexible inner wall is configured to maintain direct contact with substantially all of the surface of a foodstuff when the coolant within the coolant chamber is at higher than atmospheric pressure when the flexible inner wall is in the second position and wherein the flexible inner wall is not configured to maintain direct contact with substantially all of the surface of a foodstuff when the coolant is at a lesser pressure when the flexible inner wall is in the first position; and wherein the chamber further comprises at least one coolant inlet and one coolant outlet wherein both the coolant inlet and the coolant outlet have a quick-connect configuration to receive and operably engage a first coolant utility conveying line that operably connects a coolant tank with the coolant outlet and a second coolant utility conveying line that operably connects a coolant tank with the coolant inlet.

17. The turbo-chilling chamber of claim 16, wherein the rigid outer wall of the turbo-chilling chamber extends around the perimeter of the beverage container, but not the top of the beverage container and the turbo-chilling chamber further comprises a cover moveable between a beverage inserting and removing position and a closed position that at least substantially prevents air from outside the turbo-chilling chamber from entering the turbo-chilling air when the cover is in the closed position.

18. The turbo chilling chamber of claim 16, wherein the coolant comprises a water and solute solution where the solute depresses the freezing point temperature of the water and wherein, when in the second position, at least a substantial amount of flexible inner wall contacts the beverage container around the side of the beverage container and the bottom surface of the beverage container when the beverage container surfaces are at least substantially smooth; and operably connecting a first coolant utility conveying line to the coolant inlet;

operably connecting a second coolant utility conveying line to the coolant outlet;

placing a beverage container within the beverage container receiving space;

activating a coolant pump to increase coolant pressure in the coolant chamber above atmospheric pressure;

engaging the flexible inner wall with the beverage container such that at least substantially all of the side surfaces and the bottom surface of the beverage container contact the flexible inner wall; and moving coolant through the coolant chamber using the coolant pump to thereby chill the beverage within the beverage container via heat transfer by contact of the flexible inner wall and indirectly the coolant with the beverage container.

* * * * *